US007752823B2

(12) United States Patent
Robinson et al.

(10) Patent No.: US 7,752,823 B2
(45) Date of Patent: Jul. 13, 2010

(54) PURLIN BRACING SYSTEM FOR METAL BUILDING ROOF

(75) Inventors: Clifford M. Robinson, Blue Springs, MO (US); Russell C. Burnham, Kansas City, MO (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 30 days.

(21) Appl. No.: 11/749,821

(22) Filed: May 17, 2007

(65) Prior Publication Data

US 2008/0282635 A1 Nov. 20, 2008

(51) Int. Cl.
*E04C 2/30* (2006.01)
*E04C 3/04* (2006.01)
*E04B 7/04* (2006.01)

(52) U.S. Cl. ..... 52/664; 52/317; 52/749.12; 52/506.06

(58) Field of Classification Search ..... 52/664, 52/665, 317, 749.12, 653.1, 506.06
See application file for complete search history.

(56) References Cited

U.S. PATENT DOCUMENTS 3,092,221 A * 6/1963 Parsons et al. ..... 52/90.1
3,503,641 A 3/1970 Fraser
3,604,176 A * 9/1971 Campbell ..... 52/660
3,611,661 A 10/1971 Chambers et al.
3,661,048 A 5/1972 Judd
3,973,367 A * 8/1976 Johnson et al. ..... 52/262
4,075,807 A 2/1978 Alderman
4,151,694 A 5/1979 Sriberg et al.
4,408,423 A 10/1983 Lautensleger et al.
4,453,863 A 6/1984 Sutton et al.
4,715,156 A 12/1987 Dozzo
4,735,029 A 4/1988 Murphy
4,840,005 A * 6/1989 Cochrane ..... 52/667
4,930,285 A 6/1990 Ward
5,095,673 A 3/1992 Ward
5,152,114 A 10/1992 Beazley et al.
5,647,175 A * 7/1997 Smyth ..... 52/58
6,862,854 B1 3/2005 Fitzmyers
2005/0284081 A1 12/2005 Porter

FOREIGN PATENT DOCUMENTS

JP 2003321895 11/2003

OTHER PUBLICATIONS

International Search Report and Written Opinion issued in related PCT patent application Serial No.: PCT/US08/64142, mailed Sep. 5, 2008, 10 pages.

* cited by examiner

*Primary Examiner*—David Dunn
*Assistant Examiner*—Jason Holloway
(74) *Attorney, Agent, or Firm*—Lathrop & Gage LLP

(57) ABSTRACT

A purlin bracing system for metal building roof includes braces which have pairs of tabs extending from one end. A brace is arranged perpendicular to a purlins, and its tabs are inserted through slots in the central web of the purlin. Another brace is then applied on the opposite side of the purlin, and headed pin is dropped through aligned holes in the tabs to secure them on opposite side of the purlin's central web. No tools or special fasteners are required.

11 Claims, 6 Drawing Sheets

PURLIN BRACING SYSTEM FOR METAL BUILDING ROOF

BACKGROUND OF THE INVENTION

This invention relates to a purlin bracing system for a metal building roof.

Many modern metal buildings have roof panels which are supported by purlins running parallel to the roof ridge across structural beams typically defining bays. FIG. 1 is a diagram of a typical arrangement, looking along the ridge plane "R". The purlins "P" and the eave struts "E" have high bending stiffness in the vertical direction, less stiffness horizontally. In most instances, the purlins have to be braced horizontally at intervals. Determination of the proper bracing interval is a matter of ordinary skill not forming part of this invention.

Purlins, like other long, slender structural members loaded in bending on their "stiff" axis, want to deflect laterally and twist toward a less stiff axis. Bracing must be applied at proper intervals to prevent this mode of failure. The bracing interval can be calculated from a number of parameters, including the moment of inertia on the stiff axis, the moment on the less stiff axis, the modulus of elasticity, the distribution and magnitude of the design load, and the nature of the constraints at each end of the structural member. In practice, builders follow bracing tables which are determined mathematically or empirically.

Various purlin brace designs have been proposed and used. Some are bolted in position between the purlins; others have tabs which are inserted through slots in the purlin and then are bent over to retain the brace. A good example is Parsons' U.S. Pat. No. 3,092,221.

One method which has been long used to brace purlins is to install pairs of structural angle members between the purlins. FIG. 2 shows a conventional ("prior art") purlin brace arrangement in which a pair of structural angle members, having tabs at their ends, were installed between purlins by inserting their tabs through pre-formed slots in the purlins' webs. The tabs were then bent down to lock the parts together.

The prior designs required the use of tools of some sort. It would be an improvement to have purlin braces which could be installed quickly without tools and without specialized fasteners, and yet would remain securely in position between the purlins once they were installed.

SUMMARY OF THE INVENTION

An object of the invention is to improve the stability of roofs by improving the lateral bracing between purlins.

Another object is to simplify the construction of metal roofs by reducing the effort and tools required to brace the purlins.

A further object is to reduce the number of parts needed to construct a metal building roof.

These and other objects are attained by a purlin bracing system for metal building roofs as described below.

The present invention simplifies brace installation, reduces the number of parts required for construction, and makes it possible to remove or replace a brace, again without tools.

BRIEF DESCRIPTION OF THE DRAWINGS

In the accompanying drawings.

DESCRIPTION OF THE PREFERRED EMBODIMENT

Figure 1:
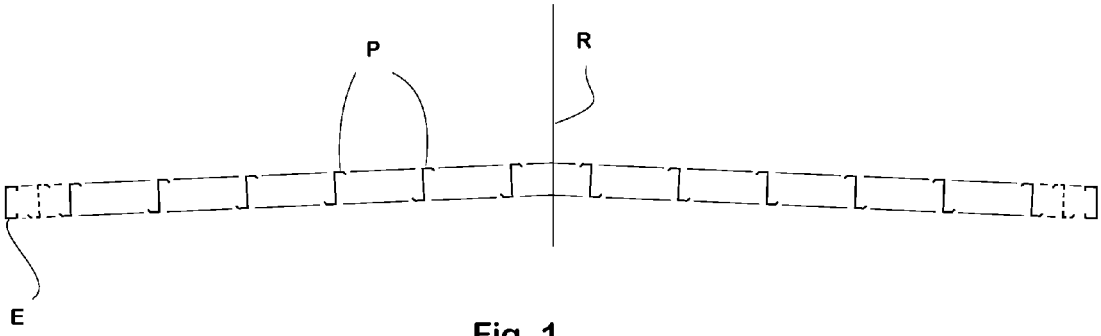
FIG. 1 is a diagrammatic sectional view of an array of purlins forming a double-slope ridged roof.
Figure 3:
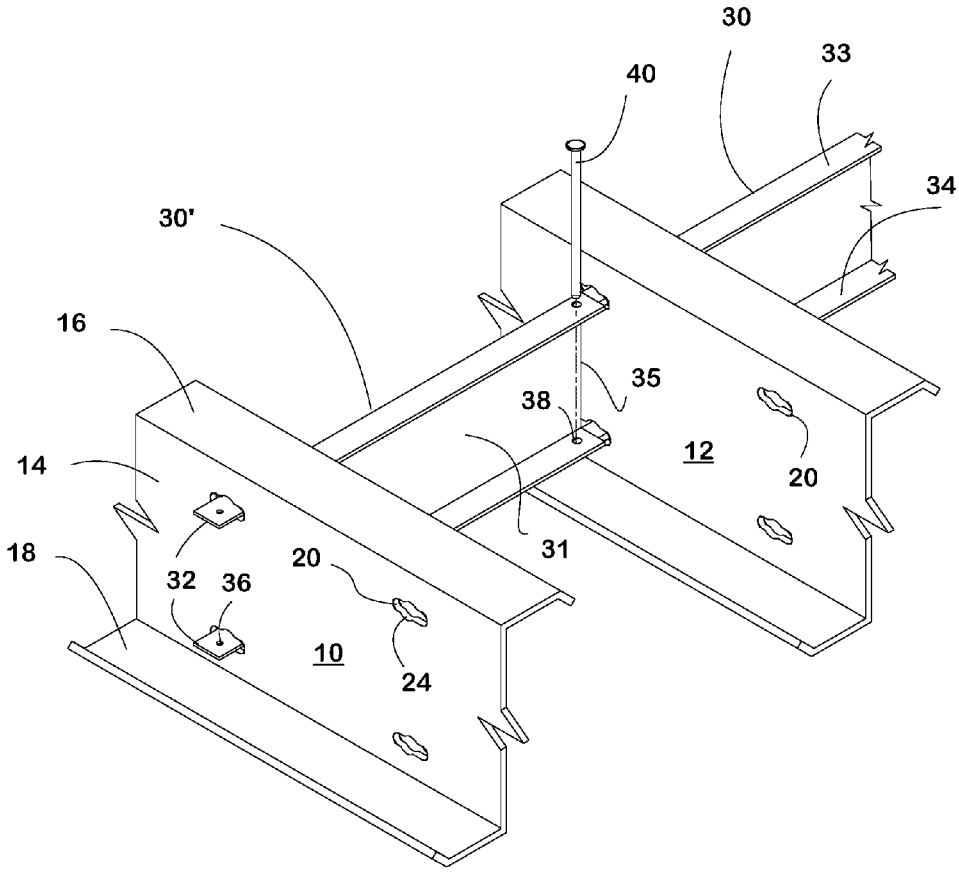
FIG. 3 is a perspective view showing portions of a pair of purlins, and a purlin brace being installed between the purlins.

A purlin brace embodying the invention is shown in FIG. 3. Two Z-section purlins 10, 12 are shown, at a point in their span between supported ends not shown. Each purlin has a central web 14 interconnecting upper and lower flanges 16, 18. Pairs of slots 20 are punched out of the web at predetermined intervals. The slots have an enlarged central portion 24 so that either the tabs 32 of the purlin braces 30, or the threaded rods 62 of eave braces 50 (see FIGS. 11-12) having threaded rod connections, can be inserted through the slots as an alternative.

The brace 30 itself is a structural steel channel member having a central web 31. The tabs 32 at one end of the brace are extensions of the upper and lower flanges 33, 34 which remain after an end portion of the web has been removed.

Figure 5:
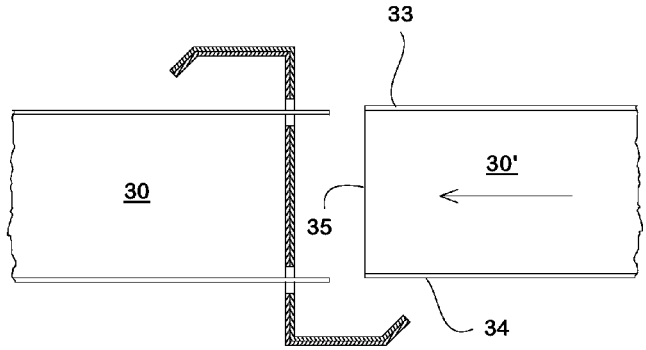
Figure 6:
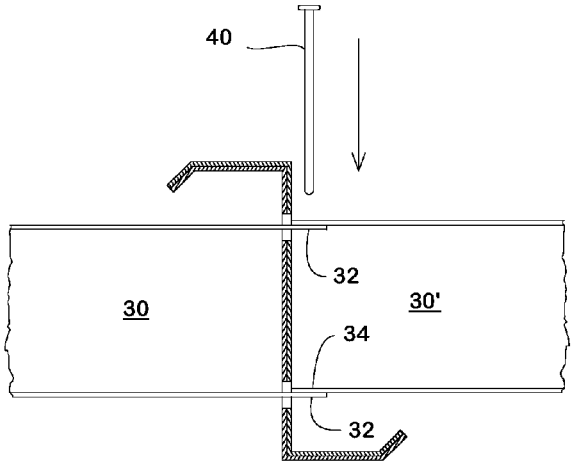
Figure 7:
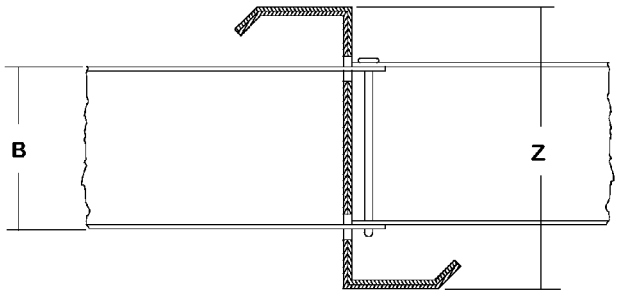

FIGS. 4-7 illustrate the assembly procedure. First (FIG. 4), the tabs 32 of a brace 30 are passed through corresponding slots 20 in a purlin "P" so that they protrude on the other side of the purlin, as shown in FIG. 5. Then the square-cut end 35 of another brace 30' is placed over the tabs, the holes 36, 38 are aligned (FIG. 6), and a headed pin 40 is dropped through the holes to secure both braces to the purlin (FIG. 7). This procedure is repeated at each of the brace locations, except that special braces described below are used at the eaves. All the purlin braces are installed without tools. No retainers are needed, gravity being sufficient to keep the pins in place, although retainers might optionally be used.

An advantage of this invention is that, by securely interconnecting the braces at both their top and the bottom flanges, the braces not only maintain the spacing between the purlins, but also prevent them from twisting. Best results are obtained if the height of the brace is substantial with respect to the height of the purlin, preferably at least half the height of the purlin.

Figure 8:
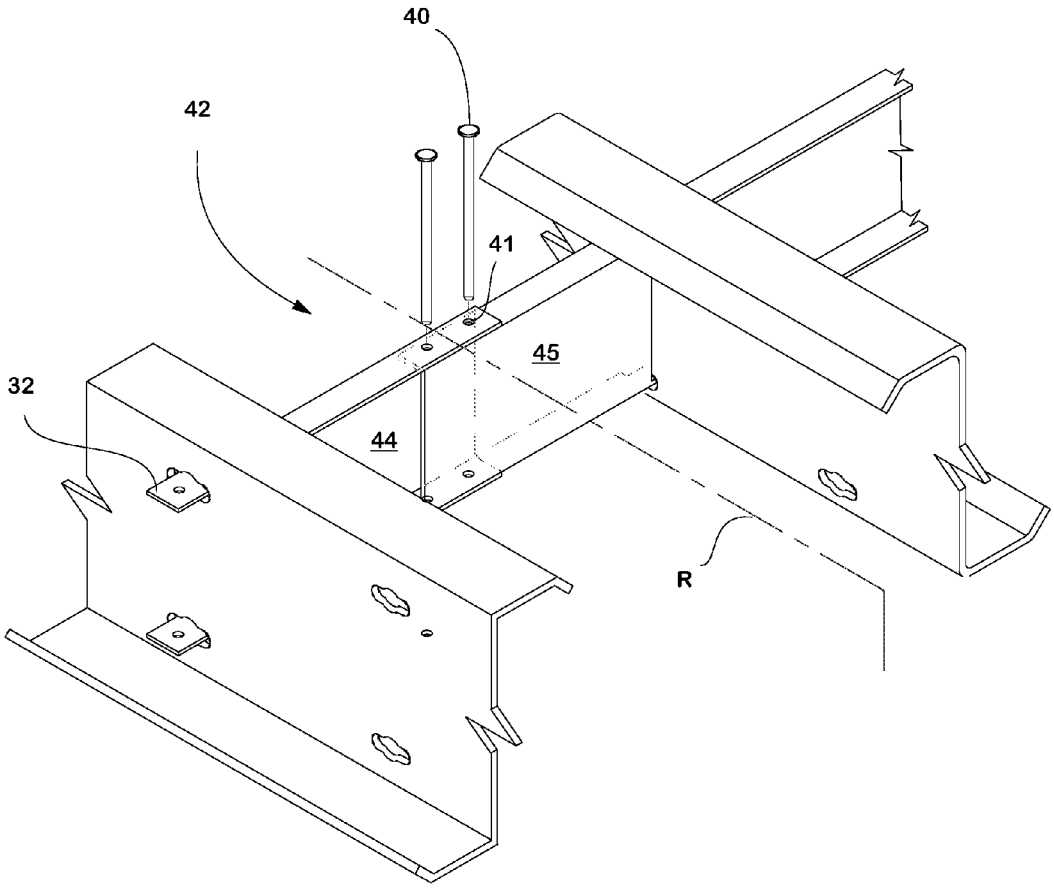
FIG. 8 is a perspective view showing bracing installed between the purlins running on either side of the roof ridge line.

At the roof ridge "R" (FIG. 8), the orientation of the purlins typically reverses, and there is an angle between the purlins as well, since their webs are actually perpendicular to the respective sloping roof surfaces on either side of the ridge. A special channel ridge brace assembly 42 is provided to accommodate the reversal and the angular change. The assembly comprises a pair of identical parts 44, 45 whose webs are cut, at their tabbed ends, at a predetermined angle corresponding to the design roof slope. The tabs 32 are inserted through slots in the purlins on either side of the ridge, and the square ends of the parts are connected to one another by inserting a pair of pins 40 through holes 41 which are pre-formed in the upper and lower flanges of the parts.

Figure 9:
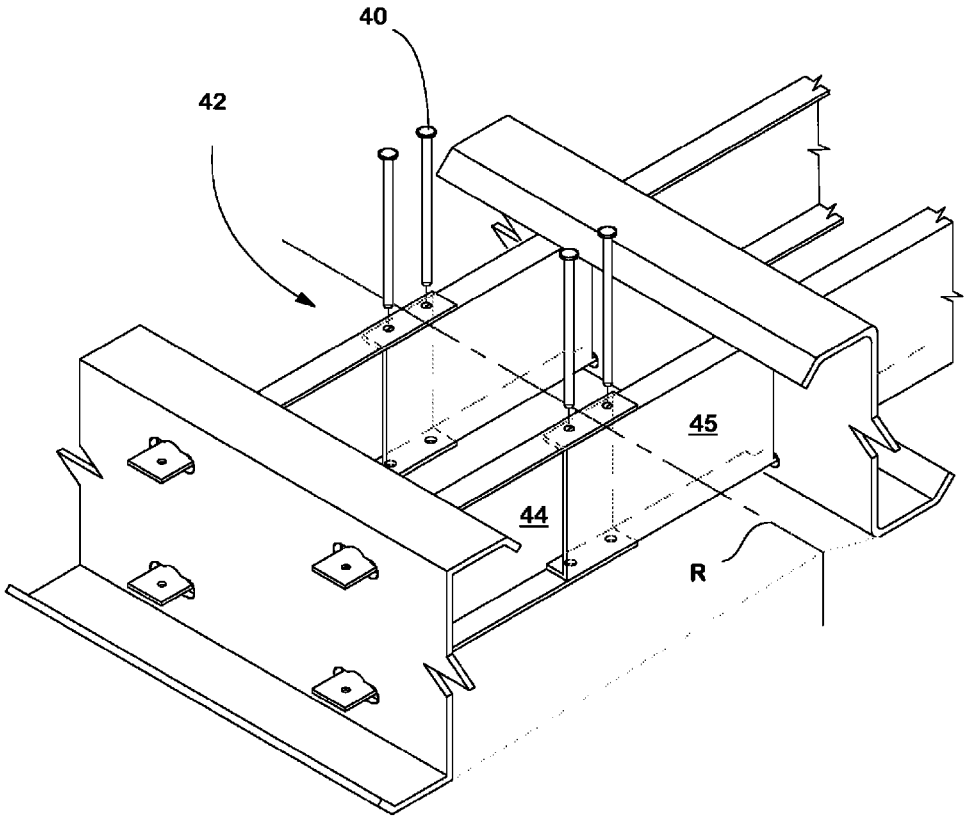
FIG. 9 shows a double-brace construction otherwise like FIG. 3.

FIG. 9 shows another variation, where more bracing is desired. In this situation, closely spaced pairs of braces are inserted between neighboring purlins. Otherwise, the designs are the same.

Figure 10:
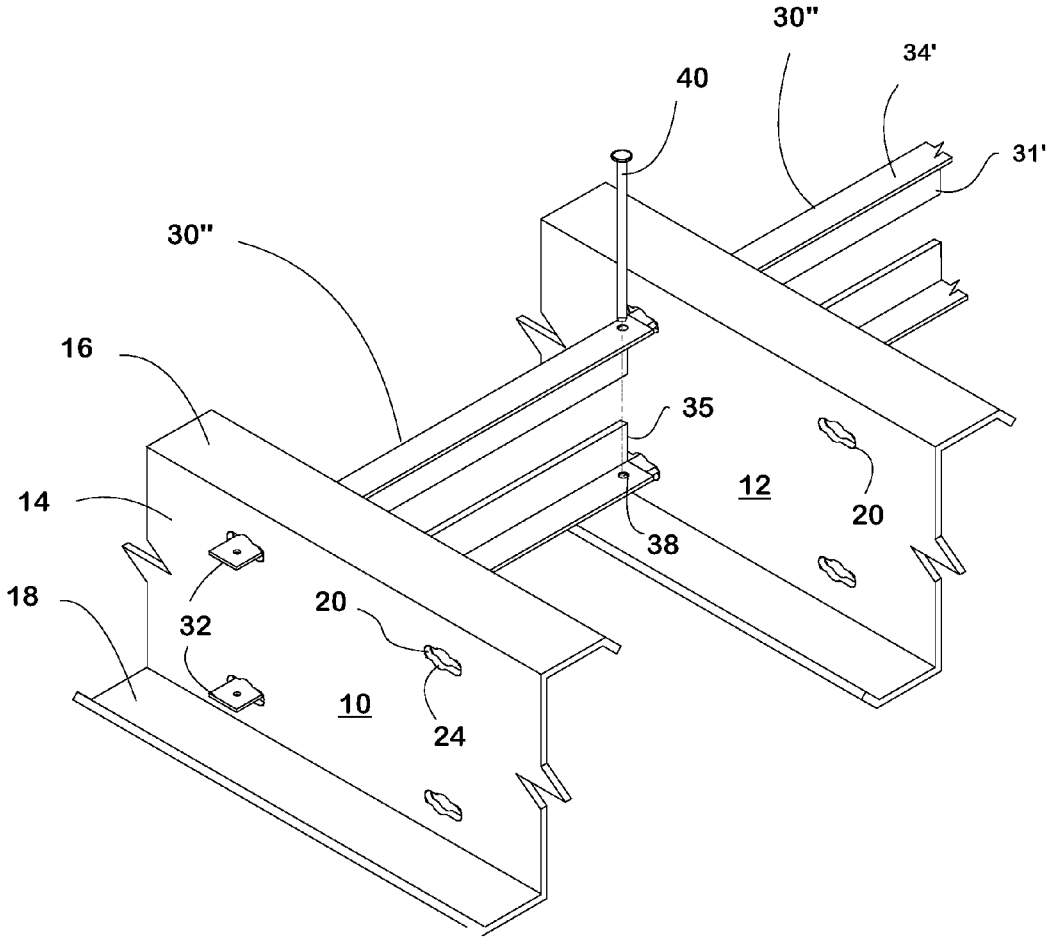
FIG. 10 shows a modified form of the purlin braces.

FIG. 10 shows a variation of the invention in which the purlin braces are not channel members having two flanges, but rather are paired angle members 30", each having a vertical flange 31' and a single horizontal flange 34'. As with the channel members described above, a tab 32 is produced by removing part of the vertical flange at one end of the brace; the protruding end of the horizontal flange then serves as the tab which is inserted through one of the slots 20 in the purlin. The square-cut end 35' of a second brace is then laid over the tab and a pin 40 is dropped through the aligned holes. Two short pins could be used in place of the long pin illustrated, if desired. As this embodiment illustrates, the invention in its broadest sense may be used with braces having various cross-sectional shapes.

Figure 2:
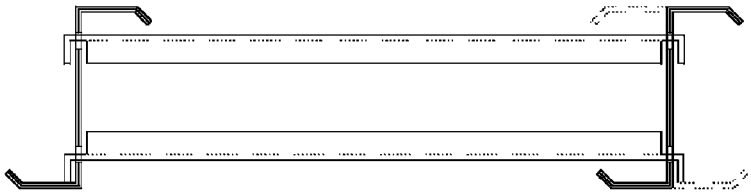
Fig. 2 (PRIOR ART)
FIG. 2 shows a prior art purlin bracing arrangement.
Figure 11:
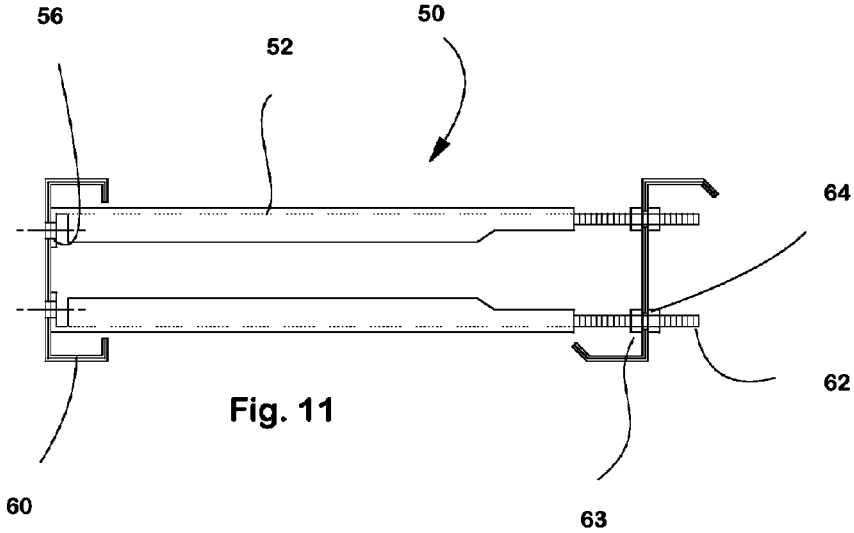
FIGS. 11 and 12 show purlin braces for use at the eaves.
Figure 12:
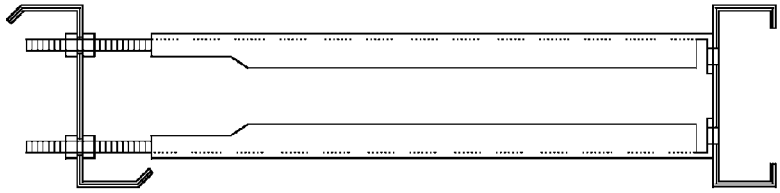
Figure 4:
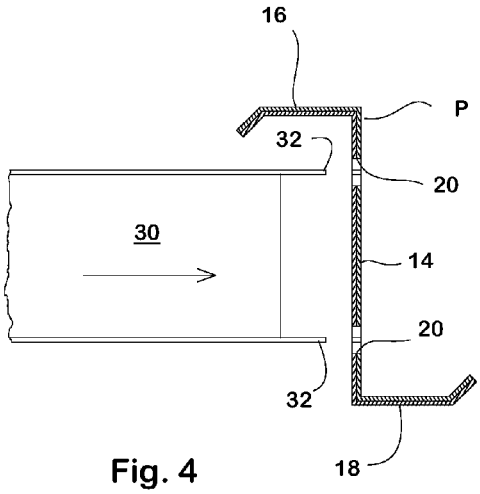
FIGS. 4-7 show sequential steps of braces being installed on either side of a purlin.

FIGS. 11 and 12 show braces for use at the eaves. Each brace is a structural member 52 whose central web is turned down at the end to form a tab 56 through which fasteners such as screw bolts (not shown) can be inserted to secure the brace to the eave strut 60. The illustrated brace has an angle-section. The threaded rod 62 extending from the opposite end of the eave strut is passed through the enlarged central portion 24 (see FIG. 2) of a purlin slot after a first nut 63 has been installed on it. A second nut 64 is then applied and tightened against the first. The nuts can be turned in or out to adjust the exact position of the eave strut relative to the outer wall of the building. Because the eave braces are installed in vertically spaced pairs, the angularity of the eave strut can be adjusted as well.

Since the invention is subject to modifications and variations, it is intended that the foregoing description and the accompanying drawings shall be interpreted as only illustrative of the invention defined by the following claims.

We claim:

1. A metal building roof comprising a plurality of substantially parallel purlins extending in a first direction, the purlins having a center web and being supported at intervals by structural building frame members, and a plurality of braces extending in a second direction, substantially perpendicular to the first direction, between neighboring purlins to prevent lateral deflection and twisting of the purlins under load, the improvement wherein at least some of said braces are channel members having a central web and upper and lower flanges, the flanges extending lengthwise beyond the central web at a first end of the brace to form a pair of protruding tabs one above the other, the purlins having pairs of longitudinally-extending slots at intervals so that the tabs of a brace can be inserted through a pair of the slots and protrude on the other side of the purlin one of said slots in each pair being above and substantially parallel to the other, the brace having holes in its tabs at its first end, and holes in its upper and lower flanges at its second end, the holes of the tabs and the holes of the flanges being disposed so that they present a visible and observable alignment from above when the respective members are abutted firmly against the purlin web on opposite sides thereof, whereby the tabs of one brace may be inserted through the slots in the purlin web from one side of the purlin and another brace may be applied from the opposite side of the purlin so as to overlap the tabs, and a plurality of drop-in pins, each of which may be inserted down and through the aligned holes of the first and second braces to interconnect them on said one side of said purlin and on the opposite side of the purlin respectively.

2. The roof of claim 1, wherein each of the purlins is substantially a Z-section member having a central web extending substantially perpendicular to a surface of the roof.

3. The roof of claim 1, wherein each pair of slots is spaced widthwise of the purlin web so that the braces are oriented, when installed, with their central webs substantially perpendicular to the roof surface.

4. The roof of claim 1, wherein the height of the brace is at least half the height of the purlin.

5. A lateral bracing system for a roof having an array of substantially parallel purlins, said system comprising a plurality of braces and a plurality of pins for interconnecting said braces, each of said braces being a channel member having upper and lower flanges connected by a central web, a portion of said web at one end of each brace being removed so that the ends of the upper and lower flanges at that end of the member form a pair of tabs, said tabs at one end of the brace and said upper and lower flanges at the other end of the brace having prefabricated aligned holes which are accessible from above and through which said pins are able to be inserted down through said aligned holes to secure the braces together to the purlin without piercing any material and without the need for any further fastening device.

6. A system for laterally bracing a structural support member on a building, said system comprising:

a first brace member having a first end including: (i) an upper tab which is receivable through an upper slot defined through said structural support member, and (ii) a lower tab which is receivable though a lower slot defined through said structural support member;

each of said upper and lower tabs having pin-receiving apertures;

a second brace member having a first end including an upper hole and a lower hole, said upper and lower holes being aligned with said pin-receiving apertures in said upper tab and said lower tab, respectively, when said first end of said second brace member is abutted against said structural support member allowing for the receipt of a pin through said holes and apertures to secure said first brace member and said second brace member to opposite sides of said structural support member; and an alignment of said apertures which enables the unobstructed insertion of said pin from above, and then compels said pin to be held in place by a gravitational field.

7. The system of claim 6 wherein said structural support member is a purlin.

8. A method of supporting a plurality of parallel purlins in a roof construction, said method comprising:

creating a plurality of cross members each having: (i) an upper flange, (ii) a lower flange, (iii) a first end presenting outwardly-extending upper and lower tabs having apertures therethrough at a first end, (iv) reciprocating holes formed in each of the upper and lower flanges at a second flush end;

adapting said cross members such that the tabs on a first cross member of said plurality of cross members can be received through upper and lower slots formed in a web of one of said plurality of purlins, and said apertures in said tabs be aligned with the reciprocating holes in the upper and lower flanges on the second flush end of a second cross member of said plurality of cross members to define a passageway for a smooth pin to be slidably received in an unobstructed fashion, thus connecting the first cross member and second cross member onto opposite sides of the one of the plurality of purlins.

9. The method of claim 8 comprising:

comprising each of said plurality of cross members of two longitudinally-extending members having opposing L-shaped cross sections.

10. The method of claim 8 comprising:

using channel members as said plurality of cross members.

11. The method of claim 8 comprising:

laterally supporting an adjacent purlin using a third cross member selected from said plurality of said cross members.

* * * * *